US006112727A

United States Patent [19]

Cristiani et al.

[11] Patent Number: 6,112,727

[45] Date of Patent: Sep. 5, 2000

[54] FUEL SUPPLY UNIT FOR AN ENDOTHERMAL ENGINE

[75] Inventors: Marcello Cristiani, Imola; Massimo Lolli, Bologna, both of Italy

[73] Assignee: Magneti Marelli S.p.A., Milan, Italy

[21] Appl. No.: 09/353,846

[22] Filed: Jul. 15, 1999

[30] Foreign Application Priority Data

Jul. 16, 1998 [IT] Italy ..... BO98A0438

[51] Int. Cl.[7] ..... F02M 37/04

[52] U.S. Cl. ..... 123/514; 123/495; 123/198 D; 123/463

[58] Field of Search ..... 123/514, 463, 123/456, 495, 198 D, 458, 446

[56] References Cited

U.S. PATENT DOCUMENTS

| | | | |
|---|---|---|---|
| 4,794,888 | 1/1989 | Lang | 123/73 SC |
| 4,829,967 | 5/1989 | Noti | 123/458 |
| 5,220,941 | 6/1993 | Tuckey | 123/463 |
| 5,454,359 | 10/1995 | Howell | 123/446 |
| 5,564,397 | 10/1996 | Kleppner | 123/514 |
| 5,567,134 | 10/1996 | Inoue | 417/490 |
| 5,692,479 | 12/1997 | Ford | 123/514 |
| 5,901,686 | 5/1999 | Stockner | 123/495 |
| 5,983,869 | 11/1999 | Cooke | 123/514 |

*Primary Examiner*—Carl S. Miller
*Attorney, Agent, or Firm*—Baker & Daniels

[57] ABSTRACT

A unit for supplying fuel to an endothermal engine, the unit comprising a manifold to which injectors are connected in order to supply fuel to the engine, a high pressure pumping device which has its output connected to the manifold and its intake connected to an extraction pump adapted to transfer fuel from the storage tank to this device and a pressure regulator adapted to regulate the pressure of the fuel supplied to the pumping device by supplying surplus fuel along a bleed duct communicating with the tank, the pumping device having at least one piston moving axially within a respective cylinder in order to define a variable volume pumping chamber. The supply unit has a leakage channel provided with a first mouth communicating with the cylinder below the pumping chamber and a second mouth communicating with the bleed duct, and an ejector disposed in the bleed duct at the location of the second mouth in order to recall along the leakage channel fuel leaking from the pumping chamber between the piston and the cylinder.

10 Claims, 5 Drawing Sheets

8b
7
122
106a
137
28
23
136
138
20
53
26
23
51b
106
21
19
51
55
30
51
18
50
16
17
33
34
36
18a
35
39
6
37
38

FUEL SUPPLY UNIT FOR AN ENDOTHERMAL ENGINE

BACKGROUND OF THE INVENTION

As is known, units for supplying fuel to the combustion chambers of an endothermal engine comprise a fuel manifold, within which the fuel to be supplied to the combustion chambers is stored, one or more injectors connected to the fuel manifold and adapted to supply, on command, a predetermined quantity of fuel to each combustion chamber, a fuel storage tank and a high pressure pump adapted to take the fuel from the storage tank in order to supply it at high pressure into the fuel manifold.

These supply units further comprise a pressure regulator of proportional type disposed on the fuel manifold in order to prevent the pressure of the fuel in the fuel manifold from exceeding a predetermined threshold value, and a recycling duct connecting the pressure regulator to the intake of the pump in order to convey, upstream of this pump, the surplus fuel that the pressure regulator draws from the fuel manifold.

The pump generally has a body provided with at least one cylindrical seat within which a respective piston can move axially between a forward position and a retracted position in order to define, at the location of an end zone of this cylindrical seat, a variable volume pumping chamber. The intake of the volumetric pump is connected to the storage tank in order to suction fuel into the pumping chamber, while the outlet of the pump is connected to the manifold in order to supply the fuel at high pressure to this manifold.

The piston is generally provided with an annular sealing gasket, which is disposed at the location of a central portion of this piston and is adapted to ensure that the connection between the piston and the cylindrical seat is fluid-tight.

Unfortunately, during operation of the volumetric pump, because of play due to an imperfect coupling between the piston and the cylindrical seat in which it is mounted, there may be leakages of fuel from the pumping chamber towards a zone of the cylindrical seat disposed below this chamber. In particular, the fuel that leaks strikes the lateral surface of the piston and, as it is at high pressure, exerts a stress on the gasket which may in the long term cause it to deteriorate. The leaked fuel may therefore flow outside the body of the pump and come into dangerous contact with the lubrication oil circuit or even with the engine components in the vicinity of the pump.

SUMMARY OF THE INVENTION

The object of the present invention is to provide a fuel supply unit which resolves the above-described problem. The present invention relates to a unit for supplying fuel to at least one combustion chamber of an endothermal engine (claim 1).

BRIEF DESCRIPTION OF THE DRAWINGS

The present invention is described below with reference to the accompanying drawings, which show a non-limiting embodiment thereof, in which.

DETAILED DESCRIPTION OF THE INVENTION

Figure 1:
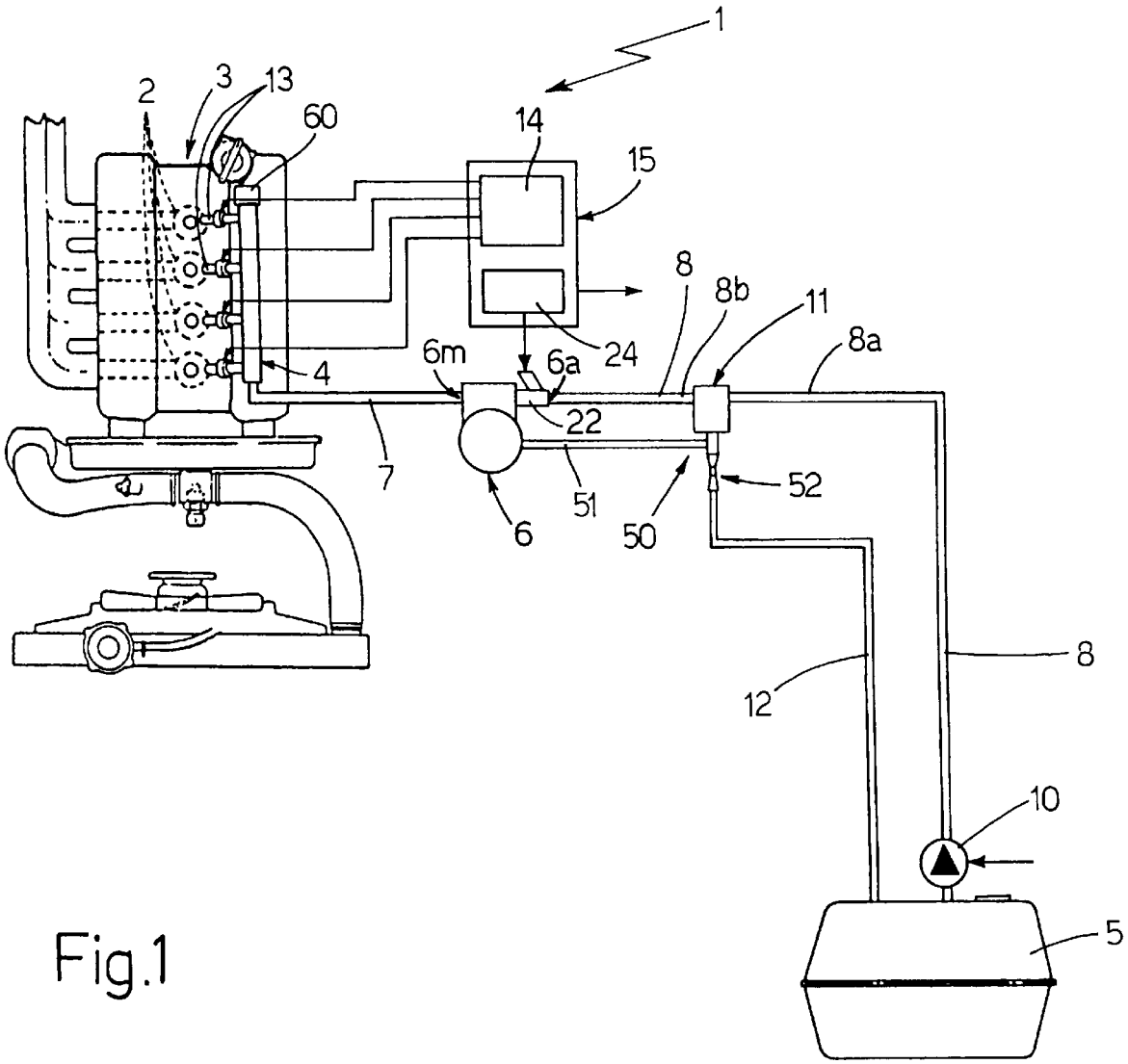
FIG. 1 is a diagram of a unit for supplying fuel to an endothermal engine according to the present invention.

In FIG. 1, a unit for supplying fuel to the combustion chambers 2 of an endothermal engine 3 of known type is shown overall by 1. In the embodiment shown in FIG. 1, the supply unit 1 is of the "direct injection" type, i.e. it is adapted to supply, on command, a predetermined quantity of fuel to each combustion chamber 2 by atomising the fuel directly within this chamber 2.

The supply unit 1 comprises a fuel manifold 4 adapted to receive and to store the fuel before it is supplied to the combustion chambers 2, a fuel storage tank 5 in which the fuel needed for the operation of the engine 3 is stored and a high pressure pumping device 6 which has its outlet **6*m* connected to the manifold 4 via a duct 7, has its intake 6*a* connected to the tank 5 via a duct 8 and is adapted to suction the fuel and to supply it at high pressure to the manifold 4**.

The supply unit 1 further comprises a low pressure extraction pump 10 adapted to suction the fuel from the tank 5 in order to supply it at low pressure along the duct 8 to the pumping device 6 and a pressure regulator 11 of known type disposed downstream of the pump 10 and upstream of the pumping device 6 in order to define, with respect to the duct 8, two portions **8*a* and 8*b*, of which the portion 8*a* connects the pump 10 to the regulator 11, while the portion 8*b* connects this regulator 11 to the pumping device 6. The regulator 11 (described below) is adapted to prevent the pressure of the fuel supplied to the intake 6*a* from exceeding a predetermined threshold value (for instance 4 bar) and, in order to regulate the pressure, is connected to the fuel tank 5 by a bleed duct 12 along which the surplus fuel from the pump 10** is conveyed.

The manifold 4 is connected to a plurality of injectors 13 (of known type) which, under the control action of a drive unit 14, are adapted to supply a predetermined quantity of fuel contained in the manifold 4 into the combustion chambers 2. In the embodiment shown, the number of injectors 13 is equal to the number of combustion chambers 2 in the engine 3 and the drive unit 14 is integrated into the engine control unit 15 which is responsible for overall management of the engine 3.

The pumping device 6 will now be described with reference to FIG. 2; this device, in this specific case, is adapted to regulate the flow of fuel introduced into the manifold 4 as a function of the quantity of fuel that needs to be supplied to the combustion chambers 2 in order to prevent a quantity of fuel greater than that which needs to be supplied to these chambers 2 from being supplied to the manifold 4.

The pumping device 6 is formed by a volumetric pump which comprises a main body 16 provided with at least one cylindrical seat 17 along which a corresponding piston 18 is mounted in an axially sliding manner in order to define, at the location of an end zone of this seat 17, a variable volume pumping chamber 19. The pumping device 6 further comprises a one-way non-return valve 20 (of known type) disposed at the location of the outlet **6*m* and along a delivery duct 21, which is provided in the body 16 and connects the pumping chamber 19 to the duct 7. The volumetric pump is lastly provided with an electrovalve 22 with controlled opening and closing, which is disposed at the location of the intake 6*a*, is borne by the main body 16 and, under the control action of a control unit 23 (integrated into the unit 15), is adapted to bring the portion 8***b* of the duct 8 into communication with an intake duct 24 provided in this body 16 and communicating with the pumping chamber 19.

Figure 2:
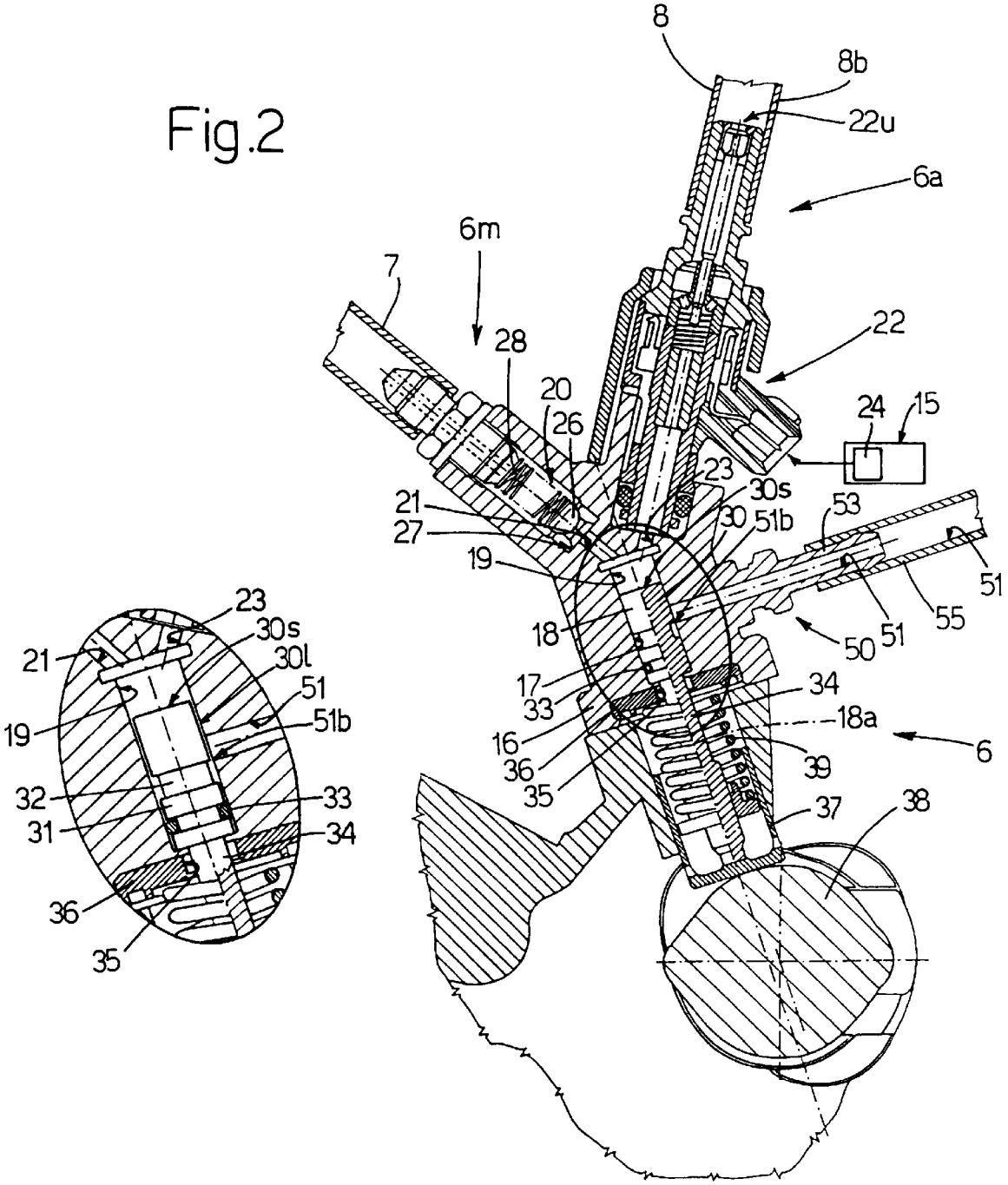
FIG. 2 shows, with some parts in cross-section and others removed for clarity, a high pressure pumping device of the fuel supply unit of FIG. 1.

The valve 20, in the embodiment shown in FIG. 2, has a sphere 26 housed in the delivery duct 21 at the location of a shoulder 27 and a spring 28 adapted to urge the sphere 26 against the shoulder 27 in order to close off the delivery duct 21. In particular, the spring 28 is calibrated so as to allow the sphere 26 to close off the duct 21 as rapidly as possible after the piston 18, completing its pumping stroke, supplies fuel to the manifold 4.

The electrovalve 22 is adapted to enable fuel to flow into the pumping chamber 19 and part of the fuel introduced into this chamber 19 to be discharged along the duct 8 towards the bleed duct 12 when, in operation, the piston 18 reduces the volume of the pumping chamber 19. The electrovalve 22 therefore enables the regulation of the flow of fuel which is pumped to the manifold 4 by regulating the discharge of fuel from the pumping chamber 19 to the bleed duct 12. In the embodiment shown in FIG. 2, the electrovalve 22 is formed by an injector of known type disposed with its nozzle 22*u* in communication with the duct 8.

A piston 18 extends along a longitudinal axis 18*a* and has a cylindrical end portion 30 whose upper base surface 30*s* defines the bottom of the chamber 19 and whose diameter, because of the inevitable play between the piston 18 and the seat 17, differs from the diameter of the seat 17 by a coupling play of the order of 10−6 m. The piston 18 further comprises a cylindrical central portion 31 which has a diameter equivalent to the diameter of the portion 30, is connected to the portion 30 by a portion 32 having a smaller diameter and is provided laterally with at least one annular sealing gasket 33 coaxial to the axis 18*a*. The gasket 33 is made partly from a rubber material in order to guarantee elasticity and partly from charged PTFE in order to guarantee resistance to wear, and is adapted to prevent any fuel that may have leaked from the pumping chamber 19 from emerging from the seat 17. The piston 18 further comprises a rod 34, which is mounted in a through manner in a hole 35 provided in an end flange 36 of the body 16, extends along the axis 18*a* externally to this body 16 and is connected to a sliding pan 37 of known type disposed on the camshaft 38 of the engine 3. In this way, the piston 18 can move axially under the action of the camshaft 38 between a forward position (known as the top dead centre), where the volume of the pumping chamber 19 is minimised, and a retracted position (known as the bottom dead centre) where the volume of this chamber 19 is maximised.

A recall spring 39 is provided between the flange 36 and the pan 37, which spring is wound about the rod 34 and, in a known manner, is adapted to ensure continuous contact between the pan 37 and the camshaft 38 by exerting an axial recall force on the rod 34 adapted to connect the pan 37 to the camshaft 38 during the stroke of the piston 18 from the forward position (top dead centre) to the retracted position (bottom dead centre), i.e. during the stage of suction of the fuel into the pumping chamber 19.

Figure 3:
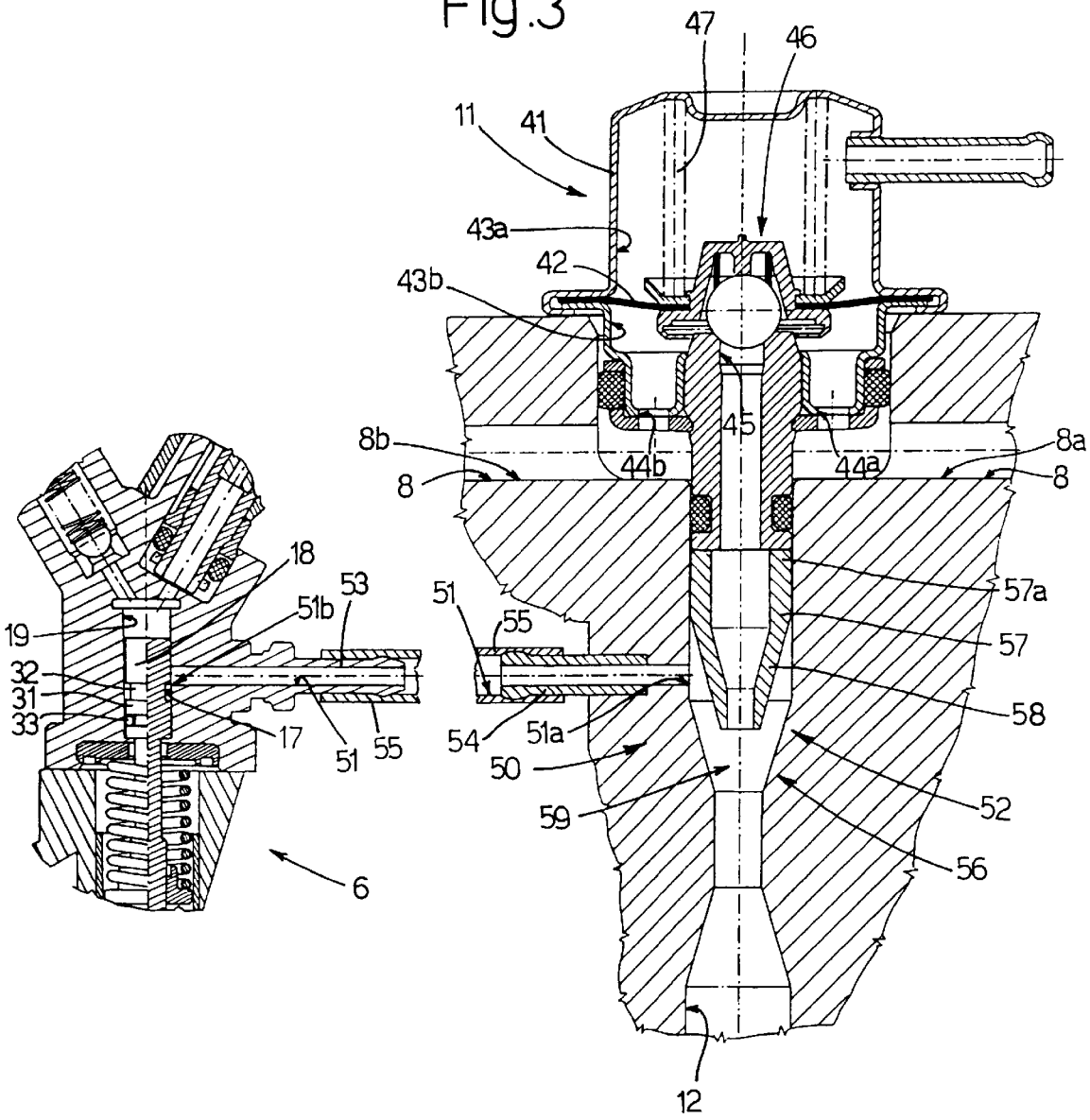
FIG. 3 shows, with some parts in cross-section and others removed for clarity, a device for recovering leaked fuel for the high pressure pumping device of FIG. 2.

With reference to FIG. 3, the pressure regulator 11 comprises a housing 41 provided internally with an elastic membrane 42 which divides this housing 41 into two chambers 43*a* and 43*b*, of which the chamber 43*b* has a hole 44*a* communicating with the portion 8*a* of the duct 8, a hole 44*b* communicating with the portion 8*b* and an aperture 45 communicating with the bleed duct 12.

The membrane 42 supports a closure device 46 disposed at the location of the aperture 45 in order to enable the surplus fuel to flow from the chamber 43*b* to the bleed duct 12 when the pressure inside the chamber 43*b* exceeds the predetermined threshold value (4 bar). This closure device 46 is kept in the position closing the aperture 45 by a calibrated spring 47 in order to close off the duct 12 if the pressure within the chamber 43*b* is lower than the threshold value.

According to the present invention, the supply unit 1 (FIG. 1) is provided with a fuel recovery device 50 adapted to recover fuel which, during operation of the pumping device 6, may leak from the pumping chamber 19 (FIG. 2) towards the portion 31 of the piston 18 because of the above-mentioned play between this piston 18 and the cylindrical seat 17.

The device 50 is adapted to prevent the fuel leaking from the pumping chamber 19 and having a high pressure (generally above 50 bar) from exerting substantial stresses on the gasket 33 causing its rapid deterioration and compromising its operation. In the absence of the fuel recovery device 50, the gasket 33 would be subject to too high pressures and, because of its deterioration, would enable the leaked fuel to emerge from the hole 35(FIG. 2) and come into dangerous contact with the engine oil circuit (not shown) or even with those components of the engine in the vicinity of the pumping device 6.

In the embodiment shown with reference to FIGS. 1, 2 and 3, the recovery device 50 has at least one leakage channel 51 connecting the cylindrical seat 17 to the bleed duct 12 and an ejector 52 which is disposed along the duct 12 in communication with the leakage channel 51 and is adapted to enable fuel that has leaked from the pumping chamber 19 to be conveyed into this channel 51 so that it can then be supplied to the storage tank 5. In particular, the leakage channel 51 has an end mouth 51*a* (FIG. 3) communicating with the duct 12 and an end mouth 51*b* (FIG. 2) communicating with the cylindrical seat 17 below the pumping chamber 19 so that it never directly faces this chamber 19. The end mouth 51*b* therefore directly faces the piston 18 and, with respect to the direction of the axis 18*a*, is positioned below the base surface 30*s* of the piston 18 and above the gasket 33, whatever the position of this piston 18. In the embodiment shown in FIG. 2, the channel 51 has an initial section provided in a connection portion 53 of the body 16, a final section provided in a connection portion 54 of the duct 12 and a central section formed by a tube 55 connecting the portion 54 to the portion 55.

The ejector 52 (see FIG. 3) has a Venturi tube 56 disposed along the bleed duct 12 at the location of the pressure regulator 11 and a further tube 57 which is positioned inside the duct 12 with one end 57*a* communicating with the aperture 45 and has a converging section 58 communicating in the vicinity of the throttle 59 of the Venturi tube 56. The end mouth 51*a* of the leakage channel communicates with the duct 12 in front of the section 58 immediately upstream of the throttle 59. In this way, when the fuel passes through the tube 57 and the Venturi tube 56 a vacuum is created at the location of the throttle 59 which recalls the fuel leaking from the pumping chamber 19 which is then supplied along the leakage channel 51 and, passing through the mouth 51*a*, is supplied along the bleed duct 12 to the tank 5.

The operation of the supply unit 1 will now be described taking account solely of one suction/pumping cycle of the pumping device 6, i.e. one outward stroke and one return stroke from the forward position (top dead centre) of the piston 18.

When the piston 18 reaches its forward position (top dead centre), the control unit 24 controls the opening of the electrovalve 22. During suction, i.e. during the displacement of the piston 18 from the forward position (top dead centre) to the retracted position (bottom dead centre), the electrovalve 22 is kept open enabling fuel to be suctioned from the duct 8 to the pumping chamber 19 and ensuring, at the same time, that the chamber 19 is correctly filled without vacuums which could lead to the formation of bubbles of evaporated fuel being created.

During suction, while the piston 18 is performing its stroke towards its relative retracted position (bottom dead centre), the engine control unit 15 calculates the quantity of fuel that needs to be supplied to the combustion chambers 2 of the injectors 13 and, ultimately, determines the quantity of fuel that needs to be supplied from the pumping chamber 19 to the manifold 4.

The control unit 24 then determines the time interval T during which, during the successive pumping stage, the electrovalve should be kept open in order to ensure that the surplus fuel contained in the pumping chamber 19 is discharged into the portion 8*b* of the duct 8.

If all the fuel suctioned into the chamber 19 has to be introduced at high pressure into the manifold 4, i.e. when the maximum flow is required, the control unit 24 controls the closure of the electrovalve 22 in phase with the positioning of the piston 18 in its relative retracted position (bottom dead centre). In this case, the electrovalve 22 remains closed for the whole of the pumping phase and all the fuel contained in this chamber 19 is pumped into the manifold 4 via the delivery duct 21.

If, however, the quantity of fuel to be supplied to the manifold 4 is lower than that suctioned into the pumping chamber 19, the electrovalve 22 is kept open for the above-mentioned period of time T during the pumping stroke of the piston 18 and the surplus quantity of fuel is introduced into the duct 8. This surplus fuel is supplied to the chamber 43*b* of the regulator 11 where, overcoming the action of the spring 47 (FIG. 3), it causes the displacement of the closure device 46 and is introduced into the bleed duct 12. After the time interval T, the control unit 24 controls the closure of the electrovalve 22 such that the desired quantity of fuel can be pumped into the manifold 4 via the delivery duct 21.

When no fuel needs to be supplied to the manifold 4 (for instance when the engine is in the "cut-off" operating state), the electrovalve 22 remains open during the entire pumping stroke of the piston 18 and all the fuel flows back to the tank 5.

In this way, by means of the regulation of the opening time of the electrovalve 22 during the pumping stroke of the piston 18, it is possible to modulate the flow of fuel supplied to the manifold 4.

It should be noted that the supply unit 1 could be provided with a mechanical pressure damping device 60 at the location of the manifold 4 (FIG. 1), in order to damp any pressure peaks in this manifold 4 before the fuel is injected by the injectors 13 into the combustion chambers 2.

The regulator 11 therefore supplies, along the bleed duct 12, both the surplus fuel that is supplied from the extraction pump 10 into the chamber 43*b* via the hole 44*a* and the high pressure fuel from the pumping chamber 19. The flow of this fuel along the tube 57 and the Venturi tube 56 causes the formation of a vacuum at the location of the throttle 59, which recalls the fuel leaking from the pumping chamber 19 along the leakage channel 51. In this way, the leaked fuel is introduced into the duct 12 via the end mouth 51*a* and can be supplied to the storage tank 5.

It is evident that the recovery of the leaked fuel via the leakage channel 51 means that the gasket 33 of the piston 18 is not subject to pressures that could compromise its operation. This makes it possible for the gasket 33 to provide a perfect seal ensuring that the engine components in the vicinity of the pumping device 6 do not come into contact with the leaked fuel.

The advantages of the supply unit 1 with respect to the known devices described above are as follows.

In the first instance, the presence of the electrovalve 22 ensures direct regulation of the flow of fuel introduced at high pressure into the manifold 4 obviating the need for a recycling duct connected to this manifold 4.

Moreover, the pumping device 6 substantially reduces energy dissipation as it is no longer necessary to supply the fuel to the manifold 4 at a pressure such as to ensure the return of the surplus fuel to the tank via the recycling duct.

Figure 4:
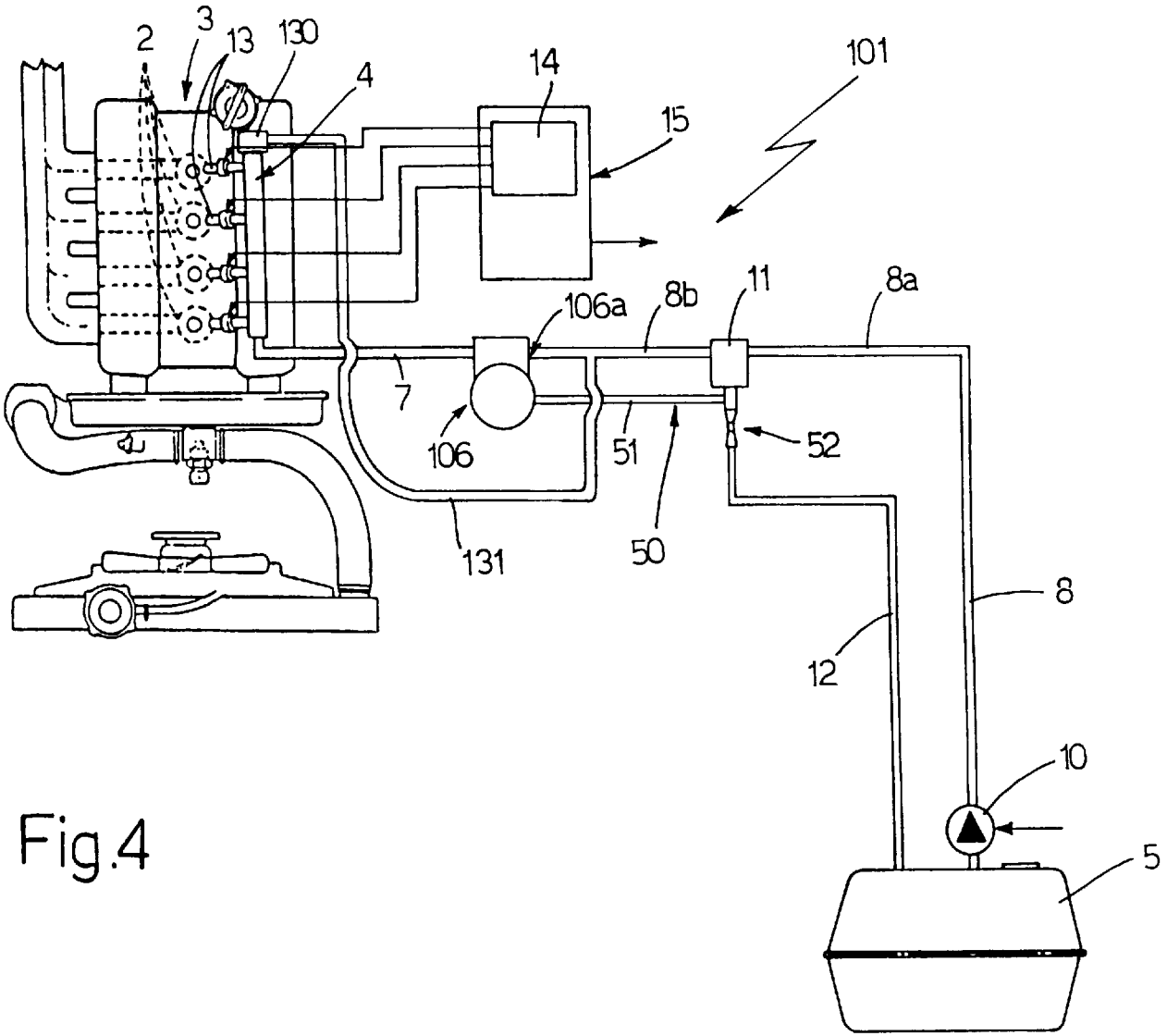
FIG. 4 is a diagram of a variant of the supply unit of FIG. 1.
Figure 5:
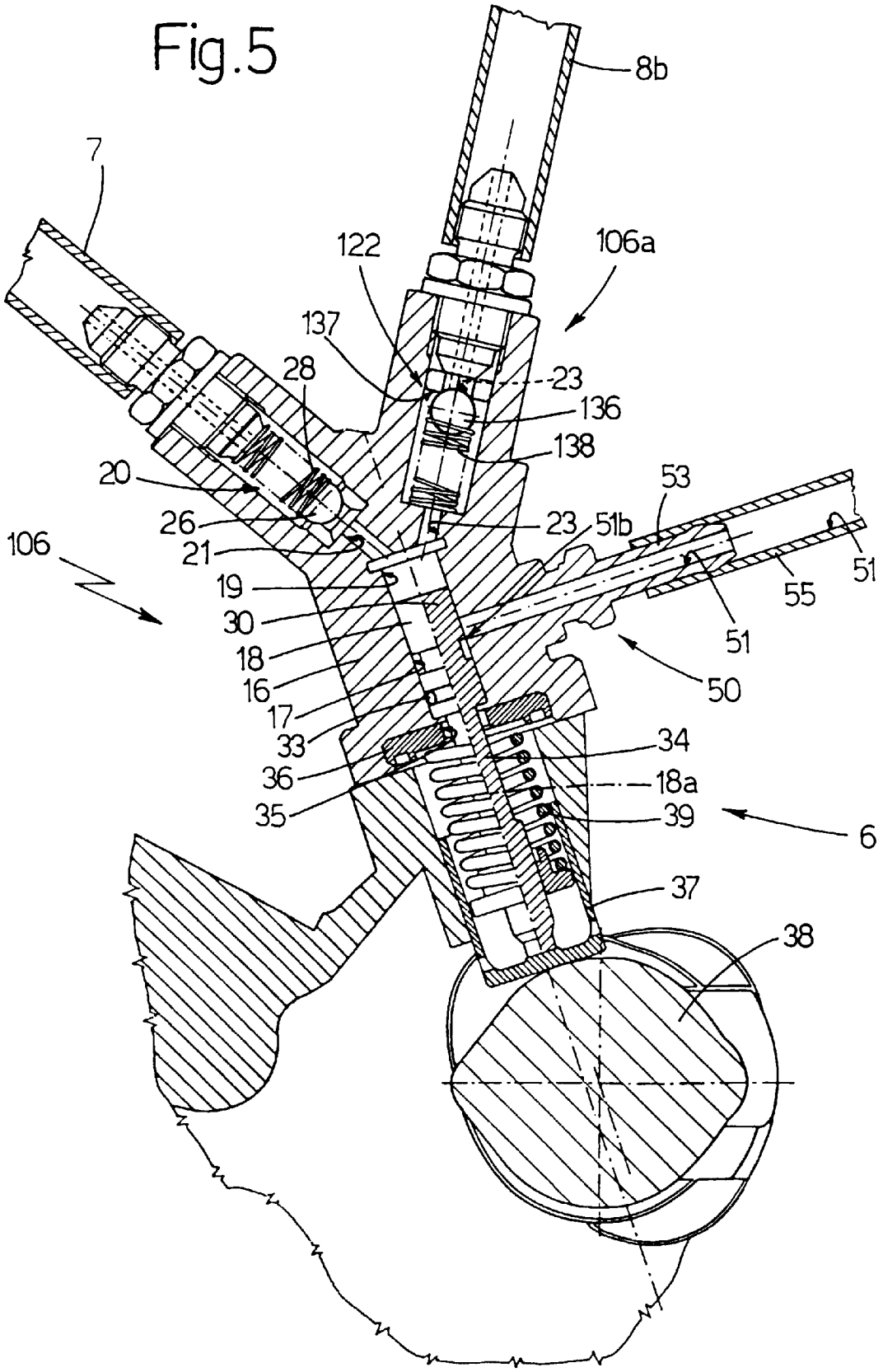
FIG. 5 show a variant of the pumping device of FIG. 2 used in the supply unit of FIG. 4.

As shown in FIGS. 4 and 5, the device 50 for recovering leaked fuel may also be used in a supply unit 101 provided with a high pressure pumping device 106 (FIG. 5) in which, in place of the electrovalve 22, there is a one-way non-return valve 122 along the intake duct. In these Figures, the same reference numerals have been used to indicate components already described in FIGS. 1, 2 and 3 with respect to the supply unit 1.

In particular, the pumping device 106, in contrast to the device 6 described above, does not enable the regulation of the flow of fuel supplied to the manifold 4 and all the fuel suctioned into the pumping chamber 19 is pumped into this manifold 4. In the supply unit 106, there is a pressure regulator 130 (of known type) disposed at the location of the manifold 4, and a recycling duct 131 connecting the pressure regulator 130 to the intake 106*a* of the pumping device 106. The pressure regulator 131 is adapted to draw a certain quantity of fuel from the manifold 4 when the pressure within the manifold exceeds a predetermined value and the quantity of surplus fuel is conveyed upstream of the pumping device 106 via the recycling duct 131.

As shown in FIG. 5, the one-way non-return valve 122 is formed by a sphere 136 housed in the duct 21 for suction 23 at the location of a shoulder 137, and a spring 138 adapted to urge this sphere 26 against the shoulder 137 in order to close off the suction duct 21. In particular, the spring 138 is calibrated such that it enables the sphere 136 to close off the duct 23 as rapidly as possible after the fuel is suctioned into the pumping chamber 19.

In this case, the fuel leaking from the pumping chamber 19 is recalled into the bleed duct 12 when part of the fuel supplied by the pump 10 to the regulator 11 is introduced into the duct 12 creating the above-mentioned vacuum at the location of the throttle 59.

It is lastly evident that the above-described concept could also be applied to pumping devices having a plurality of pistons and cylindrical seats.

What is claimed is:

1. A unit for supplying fuel to at least one combustion chamber of an endothermal engine, the supply unit comprising, a fuel manifold; at least one injector unit connected to this fuel manifold in order to supply, on command, a predetermined quantity of fuel to the combustion chamber; a fuel storage tank; a high pressure pumping device, which has its outlet connected to the fuel manifold (4) and its intake connected to the tank and in turn comprises a body provided with at least one seat and a respective piston mounted in an axially sliding manner within the seat in order to define a variable volume pumping chamber, at least one leakage channel, which has a first end mouth communicating with the seat and disposed in an axially offset position with respect to the first pumping chamber, extending externally to the body; and recall means adapted to supply the fuel leaking from the pumping chamber along the leakage channel via this first end mouth; said supply unit further comprising a bleed duct along, which fuel is conveyed to the tank, the leakage channel having a second end mouth communicating with the bleed duct, the recall means comprising an ejector disposed along said bleed duct at the location of said second mouth, said supply unit further comprising a low pressure pump adapted to take fuel from the tank in order to supply this fuel to the intake of the high pressure pumping device, and a pressure regulator interposed between the pumping device and the low pressure pump in order to regulate the pressure of the fuel supplied to the intake, the pressure regulator being connected to the tank via the bleed duct in order to supply the surplus fuel from the pump along this bleed duct, the ejector being adapted to recall the fuel leaking, from the pumping chamber when it is traversed by a flow of fuel from the pressure regulator and being adapted to supply the leaked fuel to the tank.

2. A supply unit as claimed in claim 1, wherein the ejector is adapted to create a vacuum at the location of this second mouth when the bleed duct is traversed by the fuel, this vacuum recalling the fuel leaking from the pumping chamber into the bleed duct.

3. A supply unit as claimed in claim 1, wherein the ejector comprises a Venturi tube disposed along the bleed duct in order to create a vacuum at the location of its throttle when it is traversed by a flow of fuel, the second mouth of the leakage channel communicating with the Venturi tube and the vacuum recalling the fuel leaking from the pumping chamber along the bleed duct.

4. A supply unit as claimed in claim 3, wherein the ejector comprises a further tube which is positioned inside the bleed duct and has a converging section communicating in the vicinity of the throttle of the Venturi tube, the second mouth of the leakage channel communicating with the bleed duct at the front of the converging section.

5. A supply unit as claimed in claim 1, wherein the piston comprises at least one sealing gasket disposed in a central portion of the piston in order to ensure a seal between the piston and the seat, the first end mouth of the leakage channel being disposed, with respect to a longitudinal axis of the piston, in an intermediate position between a base surface of the piston bounding the pumping chamber and the gasket.

6. A supply unit as claimed in claim 2, wherein the high pressure pumping device comprises an intake duct via which the fuel is supplied into the pumping chamber, a delivery duct via which the fuel is supplied to the manifold, first valve means disposed along the delivery duct and selectively adapted to enable the fuel to flow along this delivery duct, second valve means with controlled opening and closing disposed along the intake duct and selectively adapted to enable the fuel to flow to and from the pumping chamber, and a control unit adapted to control the opening of the second valve means in order to cause a controlled quantity of fuel to flow back from the pumping chamber to the pressure regulator enabling the regulation of the quantity of fuel pumped, at high pressure, into the manifold, the pressure regulator being adapted to supply, to the bleed duct, the quantity of fuel flowing back to the pressure regulator in order to enable a recall means to recall the fuel leaking from the suction chamber into the drain duct.

7. A supply unit as claimed in claim 1, wherein a second valve means comprises an electrovalve with controlled opening and closing.

8. A supply unit as claimed in claim 1, wherein the electrovalve is formed by an injector keyed on the body of the high pressure pumping device.

9. A supply unit as claimed in claim 8, wherein the piston has a rod extending outside the body and connected to the camshaft of the engine, this camshaft being adapted to cause the piston to slide within the seat between a forward position (top dead centre) and a restricted position (bottom dead centre) in order to vary the volume of the pumping chamber making it possible to suction fuel into this pumping chamber and to pump fuel to the delivery duct and the intake duct.

10. A supply unit as claimed in claim 9, wherein the pressure regulator comprises a reception chamber adapted to receive the fuel from the pump and having an aperture communicating with the bleed duct, and closure means disposed at the location of the aperture and adapted to enable fuel to be introduced from the reception chamber to the bleed duct when the pressure of the fuel inside the reception chamber exceeds a predetermined threshold value.

* * * * *